United States Patent [19]

Steingroever et al.

[11] Patent Number: 4,638,280

[45] Date of Patent: Jan. 20, 1987

[54] MULTIPOLAR MAGNETIZING DEVICE PROVIDED WITH COOLING MEANS

[76] Inventors: Dietrich Steingroever, 5060, Berg.-Gladbach; Erich Steingroever, Flensburger Str. 33, 5300 Bonn 1, both of Fed. Rep. of Germany

[21] Appl. No.: 778,207

[22] Filed: Oct. 29, 1985

[51] Int. Cl.[4] ..... H01F 13/00

[52] U.S. Cl. ..... 335/284; 335/300

[58] Field of Search ..... 335/217, 284, 300

[56] References Cited

U.S. PATENT DOCUMENTS 3,335,377 8/1967 Kohlhagen ..... 335/284

FOREIGN PATENT DOCUMENTS 138342 6/1970 United Kingdom ..... 335/300

*Primary Examiner*—George Harris

*Attorney, Agent, or Firm*—Harold Gell

[57] ABSTRACT

A magnetizing device for generating magnetic poles of alternating polarity in a magnetic body includes a supporting plate of electrically insulating material having a surface formed to closely conform with the surface of the magnetic body and an electrically conductive array of low electrical resistivity which includes magnetized sections of wire, or rod, recessed in the insulating plate and positioned in such a manner as to generate the desired magnetic poles in a magnetic body when supported by the plate when the array is subjected to a high-intensity unidirectional current, the array also including cooling sections of wire, or rod, twisted in the form of a double helix, interspersed between the magnetizing sections and disposed away from the magnetic body. The electrical array may be formed by a series of short lengths of wire, or rods, the respective ends of the short lengths being twisted together to form the cooling sections. To reduce electrical resistivity and twisted portions may be bonded by soldering or brazing and the cooling sections may project through the insulating plate to be enclosed in a cooling chamber.

10 Claims, 5 Drawing Figures

MULTIPOLAR MAGNETIZING DEVICE PROVIDED WITH COOLING MEANS

BACKGROUND OF THE INVENTION

The invention concerns magnetization devices for permanent magnets which have on their surface a multipole magnetization which is produced by conductors arranged to correspond to the required pole configuration, which are inserted into an insulated supporting plate so as to correspond to the shape of the part to be magnetized.

Such magnetization devices are described, for example, in our U.S. Pat. Nos. 4,470,031 and 4,381,492. Since high-intensity electrical currents are used with these devices, they are subject to the possibility of developing excessive heating in continuous use and an attempt to alleviate this problem is disclosed in German Democratic Republic Patent No. 116,982.

BRIEF SUMMARY OF THE INVENTION

The invention undertakes the task of preventing undue heating of the current conductors, and of effecting increased conduction of heat from the current conductors by interspersing the electrical circuit array on the supporting plate with cooling sections formed by twisting sections of the wire, or rod, forming the array together in the shape of a closely-wound double helix which extends through a suitable opening to a location remote from the sections of the array that generate the magnetic poles.

While the electrically conductive array may be formed from a continuous length of wire, or rod, the array may be conveniently formed from sections of wire, or rod, whose respective ends project through the supporting plate, the ends of adjacent sections being twisted together to provide a maximum surface area exposed to the air or other cooling fluid. To ensure low-resitivity in the array, the twisted portions may be bonded, as by soldering, or brazing.

DETAILED DESCRIPTION OF THE INVENTION

Figure 1:
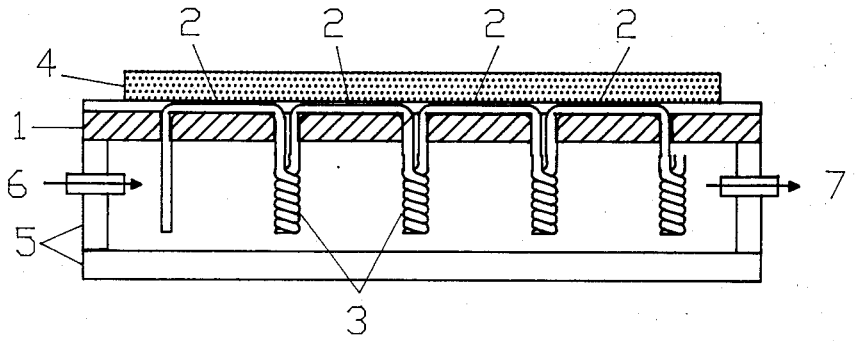
FIG. 1 is a cross-sectional elevation of a preferred form of multipolar magnetizing device according to the invention, with a magnetic body in position to be magnetized.
Figure 2:
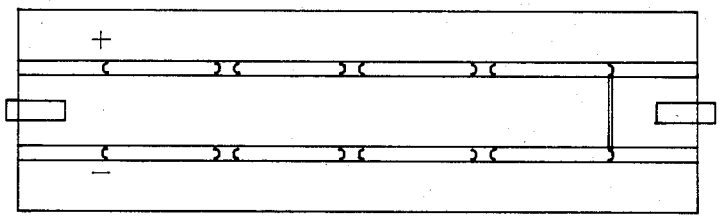
FIG. 2 is a plan view of the device of FIG. 1, with the magnetic body removed.

In the magnetizing device shown in FIG. 1, a supporting plate of electrically insulating material is indicated by numeral 1, having a surface which closely conforms with the surface of a magnetic body 4 composed of a high coercivity material, such as barium ferrite powder dispersed in a plastic, or similar material, which is to be magnetized. Recessed in the surface of the plate 1, is an electrical circuit array of conductors having magnetizing sections 2 and cooling sections 3, which may project downwardly through suitable openings in plate 1 into a closed chamber defined by side and bottom walls 5 and the supporting plate 1. Entrance and outlet ports 6 and 7 are provided to allow air, or some cooling fluid to be circulated through the cooling chamber. The sections of the electrical array may be individually formed from generally U-shaped lengths of low-resistivity conductive wires, or rods, with the respective ends of adjacent wires, or rods, being twisted closely toegther in the form of a double helix and electrically bonded, as by soldering or brazing, to provide the cooling section 3. Alternatively, it would be possible to form the entire array from a single continuous length of conductive wire, or rod, of circular or rectangular cross-section. The sections of the electrical circuit array are series-connected and magnetization is accomplished by subjecting the array to a unidirectional high-intensity current as indicated by the symbols + and − in FIG. 2.

Figure 3:
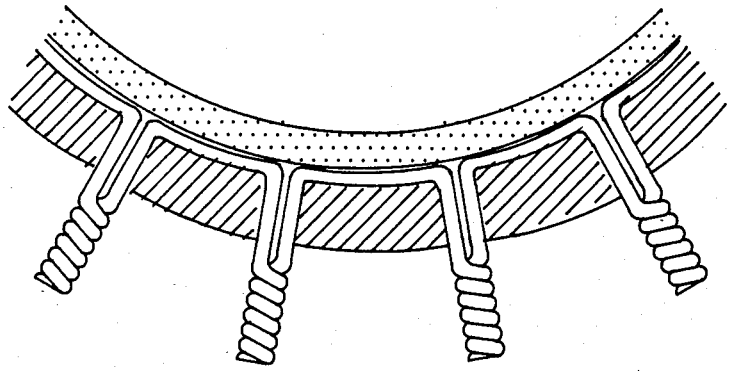
FIG. 3 is a cross-sectional view of a modified form of device for magnetizing a body having an arcuate surface configuration.

As indicated in FIG. 3, a supporting plate, indicated at 1*a*, and the magnetizing sections 2*a* with their cooling sections 3*a* can be formed in two or three dimensions to conform with any surface configuration of a magnetic body 4*a*.

Figure 4:
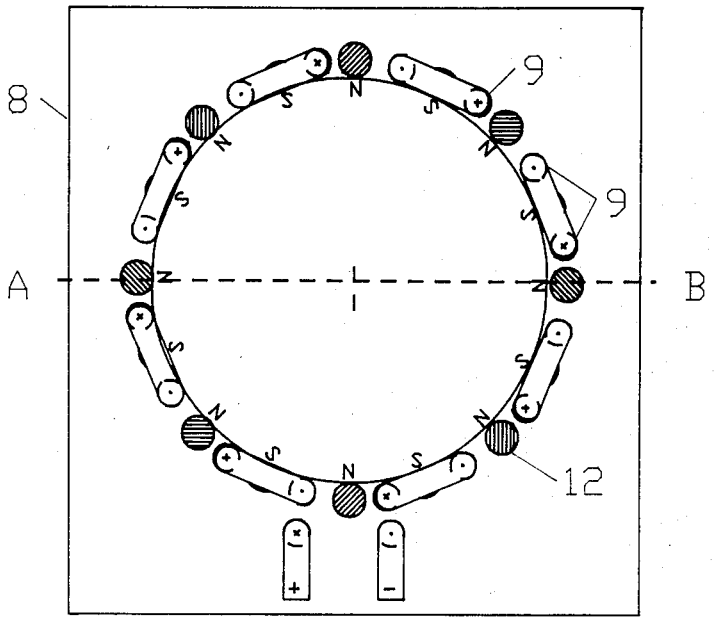
FIG. 4 is a plan view of another modification of the invention for generating multiple poles in the peripheral surface of a drum-shaped magnetic body.
Figure 5:
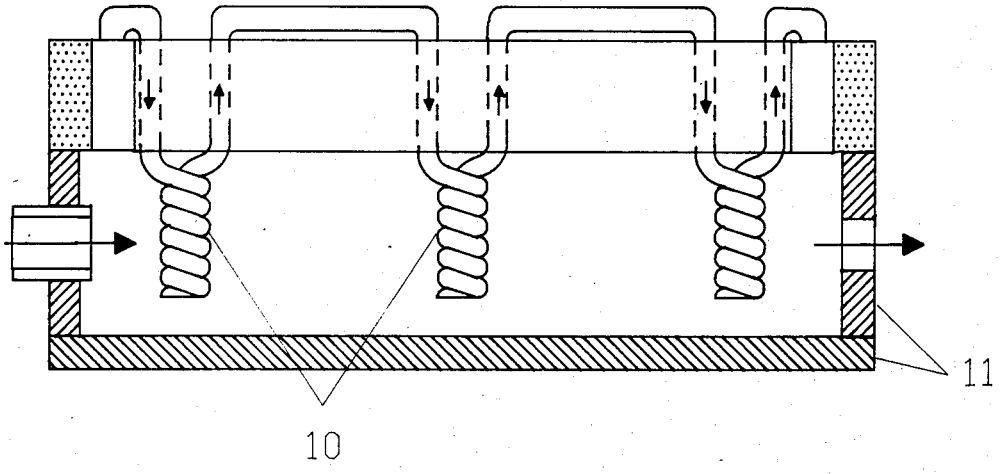
FIG. 5 is a cross-section taken on the line A—B of FIG. 4.

In the modification shown in FIGS. 4 and 5, a magnetizing device is shown for generating multiple poles, denoted by the letters N and S, in the peripheral surface of a cylindrical, or drum-shaped, magnet body. A relatively thick supporting plate of insulating material having a cylindrical opening for the magnet body is indicated by numeral 8, with the conductors 9 recessed within the inner surface thereof in a serpentine fashion. Interspersed between the magnetizing sections are the twisted cooling sections 10 disposed within a closed cooling chamber defined by the walls 11 and the plate 8. To increase the intensity of magnetization ferromagnetic bars 12 may be recessed within the plate 8 between each of the magnetizing conductors 9. As in the other modifications the magnetizing sections and cooling sections are series-connected electrical arrays to be subjected to a unidirectional high-intensity current denoted by symbols + and − in FIG. 4.

We claim:

1. In a multipolar magnetizing device for generating magnetic poles of alternating polarity in a permanent magnet body, of the type which includes a supporting plate of electrically insulating material provided with a surface to closely conform with the surface of said magnet body and an electrically conductive circuit array recessed in said insulating plate to generate selected magnetic poles in said magnet body when supported by the plate:

said conductive array including a plurality of series-connected magnetizing sections each comprising a single wire or rod, of low-resistance electrically conductive material arranged to define said magnetic poles to be generated in the magent body when energized by a unidirectional high-intensity electrical current, and;

a plurality of cooling sections each additional lengths of said wire, or rod, joining respective adjacent ends of said magnetizing sections and shaped to resemble a closely wound double helix disposed remotely with respect to said magnet body.

2. The invention defined in claim 1, wherein said electrically conductive array comprises a plurality of separate lengths of wire, or rod, a medial portion of said wire, or rod, comprising at least one of said magnetizing sections, the respective end portions of each of said lengths being twisted closely together with a respective end portion of an adjacent length of wire, or rod, to provide a cooling section.

3. The invention defined in either one of claims 1 or 2, wherein said plate of insulating material comprises a wall of a closed cooling chamber, said magnetizing sections being disposed on the exterior side of said wall, said wires, or rods, extending through suitable openings in said wall to place said cooling sections within said closed chamber.

4. The invention defined in claim 3, wherein said cooling sections are disposed generally at right angles to said magnetizing sections.

5. The invention defined in claim 3, wherein said cooling sections are disposed generally parallel to said magnetizing sections.

6. The invention defined in claim 5, wherein said magnetizing sections are generally U-shaped, the leg portions of said sections being spaced in parallel relationship to each other to generate parallel magnetic poles in the periphery of a magnetic body.

7. The invention defined in claim 6, wherein bars of ferromagnetic material are embedded in said insulating plate between the legs of the U-shaped sections to increase the magnetizing effect.

8. The invention defined in claim 3, wherein at least a portion of the surfaces of said wires, or rods, of the respective cooling sections are bonded together by soldering or brazing to minimize the electrical resistivity of the array.

9. The invention defined in claim 3, wherein the surface of said plate of insulating material is defined by an arcuate plane.

10. The invention defined in claim 3, wherein the surface of said plate of insulating material is shaped to conform with a body to be magnetized which has a three-dimensional configuration.

* * * * *